United States Patent [19]

Riordan

[11] 4,207,037

[45] Jun. 10, 1980

[54] STATOR FOR A DOWNHOLE FLUID OPERATED MOTOR AND METHOD OF ASSEMBLING THE SAME

[75] Inventor: Mathew B. Riordan, Missouri City, Tex.

[73] Assignee: Eastman Whipstock, inc., Houston, Tex.

[21] Appl. No.: 925,120

[22] Filed: Jul. 17, 1978

[51] Int. Cl.[2] ..... F04C 1/06; F04C 5/00; B23P 19/02; F16L 9/14

[52] U.S. Cl. ..... 418/48; 418/153; 29/234; 29/525; 138/140

[58] Field of Search ..... 418/48, 152, 153, 156; 29/234, 525; 138/140, 44; 175/107

[56] References Cited

U.S. PATENT DOCUMENTS

| | | | |
|---|---|---|---|
| 2,110,783 | 3/1938 | Welker | 138/140 X |
| 3,280,753 | 10/1966 | Zimmer | 418/48 |
| 3,369,494 | 2/1968 | Seddon | 418/48 |
| 3,435,772 | 4/1969 | Schlecht | 418/48 |
| 3,912,426 | 10/1975 | Tschirky | 418/48 |

FOREIGN PATENT DOCUMENTS

| | | | |
|---|---|---|---|
| 2147452 | 3/1973 | Fed. Rep. of Germany | 418/48 |

*Primary Examiner*—Leonard E. Smith

*Attorney, Agent, or Firm*—Jennings B. Thompson; Marvin B. Eickenroht

[57] ABSTRACT

A stator is disclosed for use with down-hole fluid powered drilling motors of the Moineau type. It includes a housing and a plurality of removable stator sections positioned in end-to-end, abutting relationship in the housing. Each section comprises a cylindrical body of elastomeric material having an obround opening extending longitudinally therethrough. The opening spirals along a helical path with a pitch equal to the length of the section. A method is disclosed for positioning a plurality of the sections in a statorhousing in end-to-end, abutting relationship with the opening properly oriented to form a continuous helical opening through the stator to receive a helically shaped rotor having one half the pitch of the helical opening. Each section includes a cylindrical reinforcing member embedded in the body of elastomeric material. An annular portion of the body has an outside diameter greater than the inside diameter of the housing. The annular portion is compressd between the housing and the reinforcing member when the section is installed in the housing to form a fluid seal between the housing and the section. The compressed annular portion also provides sufficient friction to hold the section from rotating relative to the housing when the rotor rotates relative to the section as fluid is forced through the opening in the section.

7 Claims, 11 Drawing Figures

FIG. 1
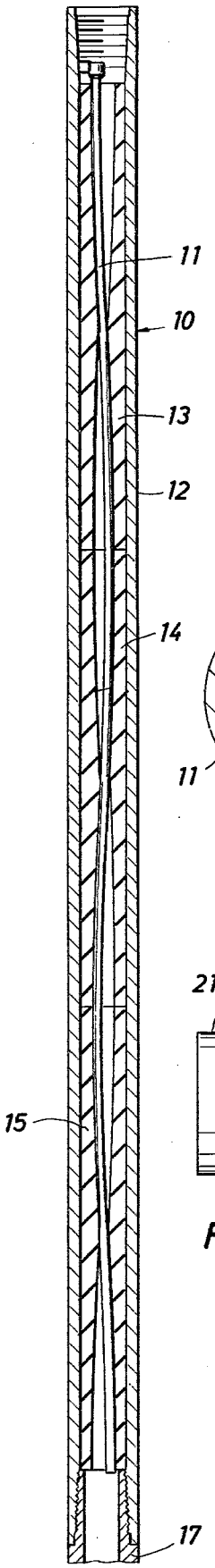
FIG. 2
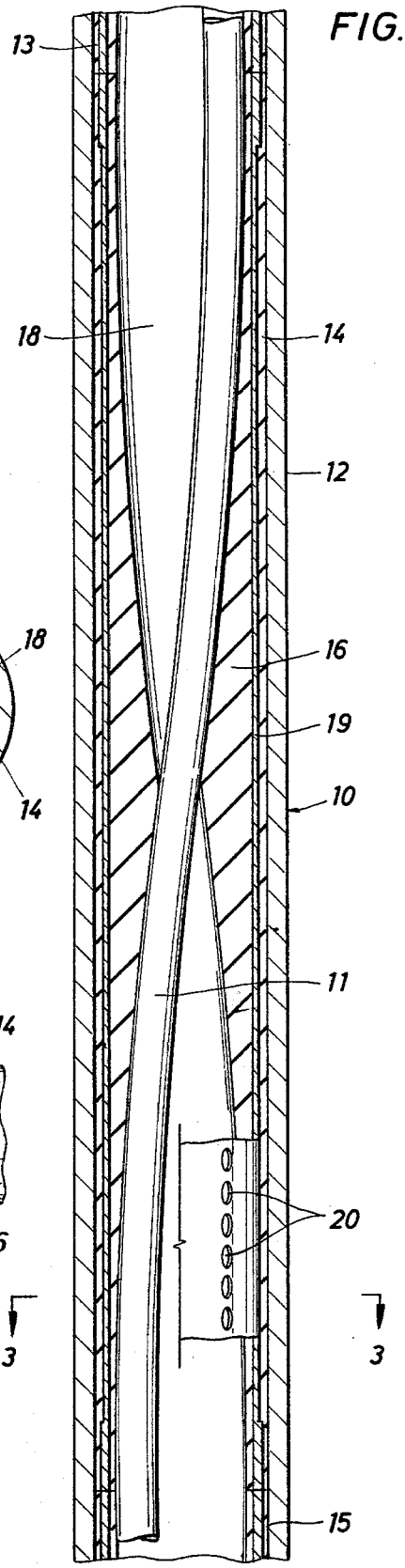
FIG. 3
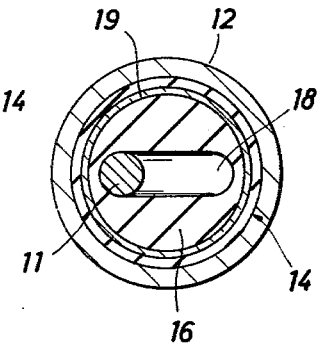
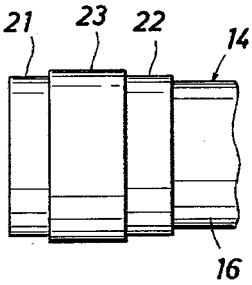
FIG. 4

STATOR FOR A DOWNHOLE FLUID OPERATED MOTOR AND METHOD OF ASSEMBLING THE SAME

This invention relates to downhole positive displacement fluid motors and in particular to an improved stator for such motors and a method for assembling and disassembling the stator.

Moineau type pumps have been used as downhole motors in drilling operations for many years. These motors are of positive displacement type and are powered by the drilling fluid pumped through the drill pipe and through the motor. The motor includes a stator and a rotor. The stator comprises a housing in which is molded a body of elastomeric material. An opening that is "obround" in cross-section extends longitudinally through the elastomeric material. The opening extends through the stator along a helical path. The rotor is a solid shaft-like member that is also shaped as a helix but which has a pitch usually about one half that of the pitch of the helical opening through the rotor. As fluid is forced through the opening in the stator, the rotor is forced to turn on its longitudinal axis. When the motor is used as a downhole motor, the rotor is connected to a drilling bit and the rotation of the rotor is imparted to the bit.

Heretofore, it has been the practice to mold the body of elastomeric material in place in the stator housing so that the elastomeric material is bonded to the inside surface of the housing during the molding operation. This secured the elastomeric material from rotating relative to the housing. At the time of molding, the helical opening extending through the stator was formed. Usually, a multi-stage motor is used as a downhole motor, with a stage being defined as a section of the stator that is equal in length to the pitch of the helical opening. Commonly, three stages are provided.

With this arrangement, when the elastomeric material of the stator has worn or erroded away to the point where a new stator is required, the entire assembly had to be replaced. The only thing that could be salvaged from the worn stator would be the housing and this could be done only by burning out or cutting away the worn body of elastomeric material and molding a new body of such material in the housing.

As a practical matter, this type of stator could not be repaired in the field and complete three stage stators had to be maintained in stock in the field whereever these motors were operated so that when required, a new stator would be available to replace the old worn-out stator.

It is an object of this invention to provide a stator for a positive displacement Moineau type downhole motor that includes replaceable stator sections of elastomeric material that can be removed and replaced in the field. With this arrangement, for example, if each stator section comprises one stage of the multi-stage motor, when one stage becomes worn sufficiently that it must be replaced and the other two stages are still in operating condition, then the one stage can be replaced in the field and the motor placed back in sevice. This reduces substantially the cost of repairing worn stators since usually only one stage of the stator will require replacement at a time and the remaining life of the other two stages can be salvaged. In other words, the elastomeric material in each stage of a multi-stage downhole motor of this type does not wear uniformly and if it is possible to replace only the worn stage, a tremendous savings can be realized in the cost of repairing these downhole motors.

It is another object of this invention to provide a method of installing and removing a plurality off stator sections having helical openings therethrough so that when assembled the sections will provide a continuous helical opening through the stator.

It is a further object of this invention to provide a removable stator section for the stator of a Moineau type positive displacement downhole motor that provides a fluid seal between the stator section and the housing in which it is located and also sufficient frictional engagement between the stator section and the housing to hold the stator section against rotation relative to the housing during operation of the motor.

Another advantage and feature of this invention is that the dimensional fit between the rotor and stator of this type motor is a direct function of motor efficiency. Normal motor wear primarily of the elastomeric material is not constant in each stage of any given motor. With multiple stator sections in the stator, a selective fit at each stage can be obtained which will result in improved performance and longer life of the motor. In addition, the environment in which these motors are used varies widely. For example, it may be desirable to use one type of elastomeric material or rubber with one type of mud that is to be pumped through the motor to obtain the longest life for the motor. Another type of mud may require a different type of elastomeric material. Also, the temperature of the wells in which this type motor is used may dictate the selection of various types of elastomeric material. With this invention, stator sections having a wide range of different type of elastomeric material to be maintained in stock in the field. This allows a stator to be assembled in the field having stator sections made up of the elastomeric material best suited for the environment in which the motor is to be used.

These and other objects, advantages and features of this invention will be apparent to those skilled in the art from a consideration of the attached drawings and appended claims.

In the drawings:

FIG. 1 is a longitudinal sectional view through a three stage downhole motor of the Moineau type with the preferred embodiment of the stator of this invention.

FIG. 2 is a longitudinal sectional view on an enlarged scale of the downhole motor of FIG. 1, showing one stage thereof.

FIG. 3 is a cross-sectional view along line 3—3 of FIG. 2.

FIG. 4 is a view in elevation of one end of the perferred embodiment of the stator section of this invention.

Figure 5A:
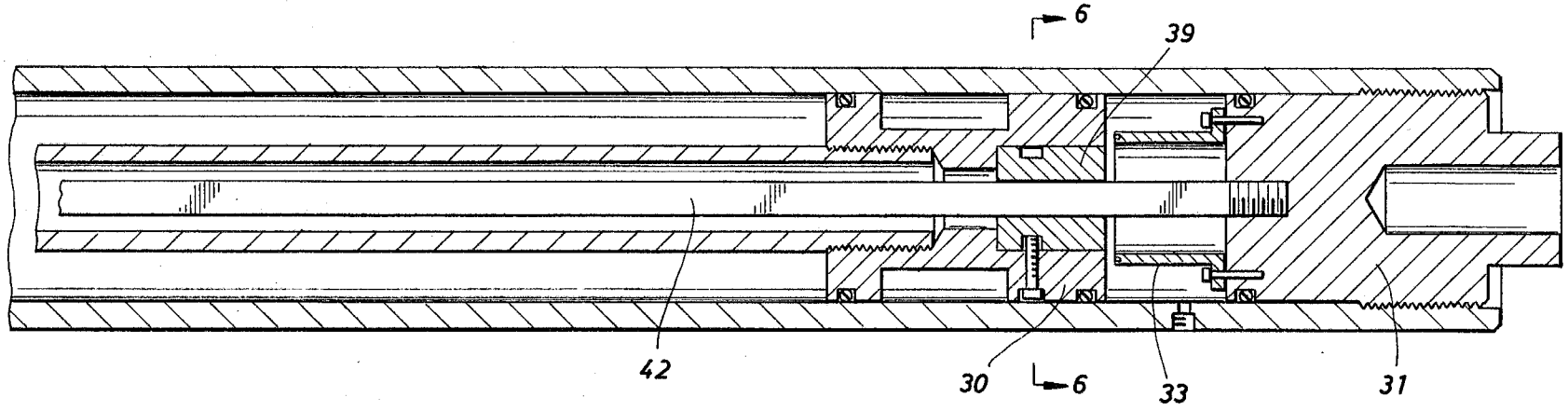
Figure 5B:
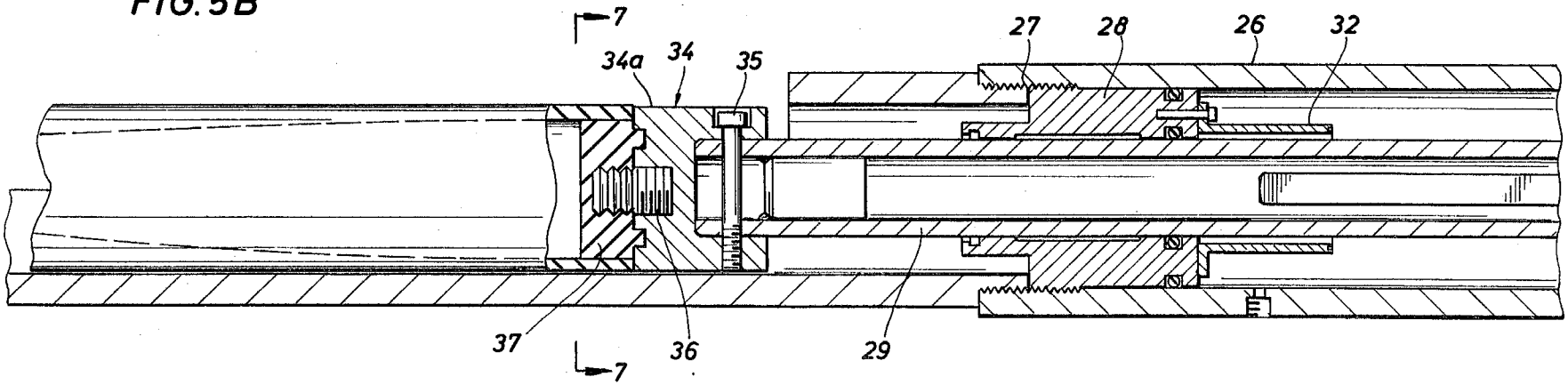
Figure 5C:
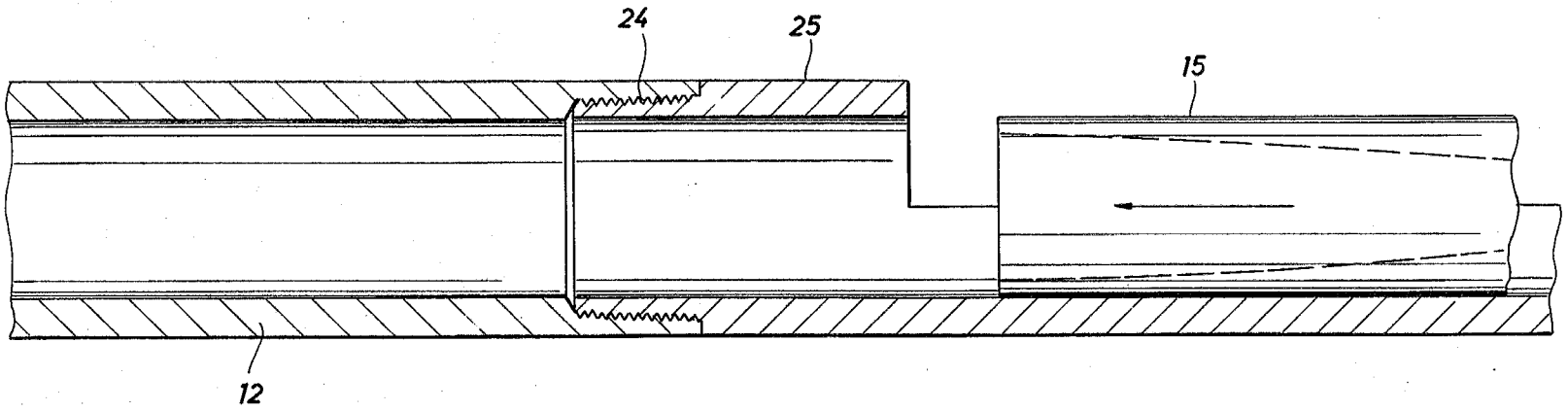

FIGS. 5A, 5B, and 5C are longitudinal sectional views through the apparatus employed to practice the method of installing and removing the stator sections.

Figure 6:
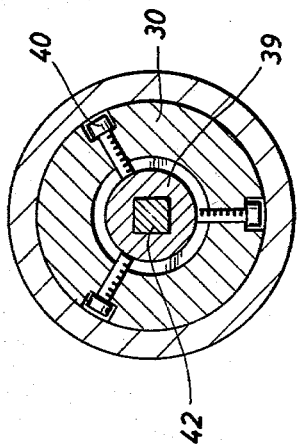

FIG. 6 is a sectional view taken along line 6—6 of FIG. 5A.

Figure 7:
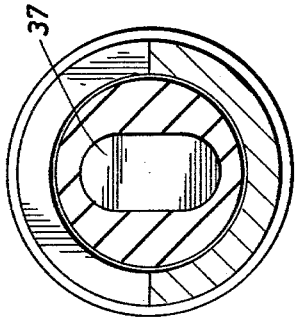

FIG. 7 is a sectional view taken along line 7—7 of FIG. 5B.

Figure 8A:
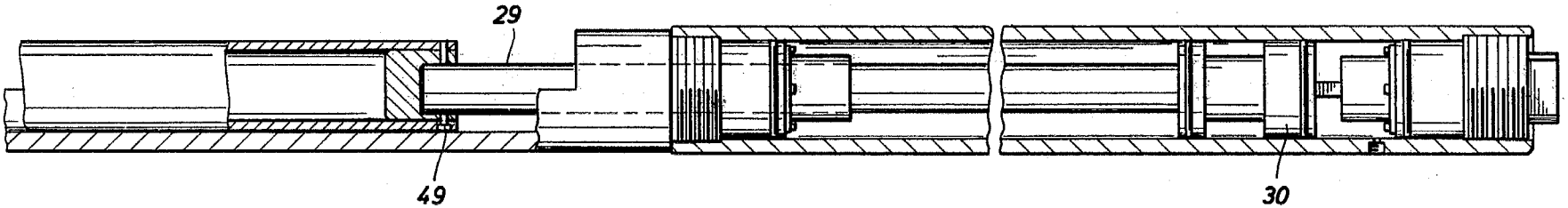
Figure 8B:
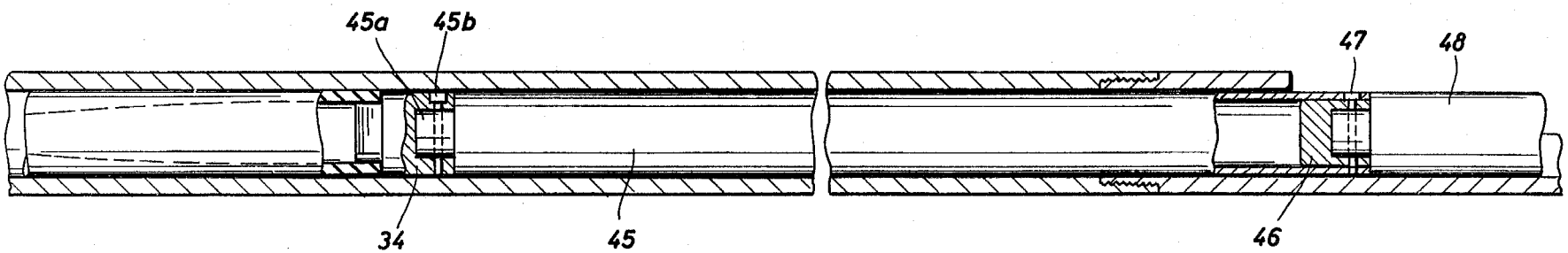

FIGS. 8A and 8B are views partly in elevation and partly in section of the apparatus of FIGS. 5A, 5B and 5C in position to install the first section in the stator housing.

The motor shown in FIG. 1 has stator 10 and rotor 11. The stator includes housing 12 and a plurality of stator sections positioned in the stator housing in end-to-end, abutting relationship. In the embodiment shown, three sections, 13, 14, and 15, are so positioned in the stator housing.

Each stator section is identical and therefore only one will be described in detail. FIGS. 2, 3 and 4 show stator section 14 on an enlarged scale from that shown in Figure one. The section includes body 16 of elastomeric material that is generally cylindrical in shape. Opening 18 extends longitudinally through the section along a helical path. Opening 18 is shaped in cross-section as shown in FIG. 3. Shape has been called "obround." The opening rotates along the longitudinal axis of the section as it moves along the helical path so that the section as shown in FIG. 3 will rotate 360° as it moves through one complete helical curve. This distance is of course the pitch of the helix and is also considered one stage of the downhole motor.

Preferably, and in the embodiment shown, each stator section has a length equal to the pitch of the helical curve followed by the opening through the stator. Therefore, with three such sections, a three stage stator is provided.

Embedded in the body of elastomeric material is reinforcing member 19; this member is made of rigid material, such as steel, and is generally cylindrical in shape. It has an outside and inside diameter such that it will be embedded in the the body of elastomeric material when the body is molded. The reinforcing member is provided with a plurality of perforations 20 through which the elastomer or rubber can flow during the molding operation to connect the portions of the rubber on opposite sides of the reinforcing member.

Means are provided to form a fluid seal between the stator section and the inside surface of the stator housing. In the embodiment shown, and as best seen in FIG. 4, body 16 of elastomeric material has three portions of increased diameter adjacent the end of the section. In the preferred embodiment, annular sections 21 and 22 have an outside diameter substantially equal to the inside diameter of the housing. Annular section 23, however, has an outside diameter such that a substantial interference fit is obtained between this annular portion and the inside surface of the housing. For example, in one commercial embodiment, the interference fit was 0.031.

Also, preferably, the other end of the section is formed in the same manner. With this arrangement, when stator section 14 is forced into housing 12, annular portion 23 will be compressed between the inside diameter of the housing and cylindrical reinforcing member 19, forming a fluid seal between the outside surface of the section and the inside surface of the stator. It is very important that fluid be prevented from migrating around the outside of the stator sections and flowing between the stator sections and the housing since this will cause rapid errosion of the elastomeric material and greatly shorten their life.

Annular portion 23 serves an addition function in that means must be provided to hold the stator sections from rotating around their longitudinal axis relative to the stator housing. As rotor 11 is forced to rotate relative to the stator by the fluid being pumped through the motor, there will be a reactive torque imposed upon the stator sections tending to urge them to rotate in the opposite direction. To prevent this, in the embodiment shown, annular section 23 that forms the fluid seal also provides sufficient friction between the body of elastomeric material from which this portion is formed and the inside surface of the stator housing to resist such reactive torque and hold the stator section from rotation relative to the housing.

In operation, the motor is connected into the drill string in the conventional manner. The lower end of rotor 11 is connected to an output shaft (not shown) that is connected in a well known manner to provide torque to a drill bit. When the lower end of the stator housing is connected to the next lower section 17 of the drill string, this section will serve to hold the stator sections from moving longitudinally relative to the housing. This may tend to occur due to the pressure drop across the motor when it is operating.

FIGS. 5A, 5B, and 5C show the apparatus provided for positioning the stator sections in the stator housing and for removing them when that is required. The apparatus is shown in position for moving one of the stator sections into the stator housing. The apparatus will be described from left to right, in other words beginning with FIG. 5C Stator housing 12 is connected by threaded connection 24 to breech member 25. This member is a tubular member with a window cut in its side wall through which stator sections can be positioned for movement longitudinally out the end of the breech member and into stator housing 12. Preferably, the inside diameter of the breech member is larger than the inside diameter of the stator to avoid undue interference with annular portions 23 on the sections that form the fluid seal with the inside of the stator housing.

If we arbitrarily assume we are going to move the stator sections from the upper end to the lower end of the stator, then the first section will be section 15, which is shown in the breech member in FIG. 5C. In FIG. 5B, the other end of breach member 25 is shown connected to cylinder 26 by threads 27. One end of cylinder 26 is closed by end plug 28 through which extends piston rod 29. The right hand end of piston rod 29 is connected to piston 30. The right hand end of cylinder 26 is closed by end plug 31 as shown in FIG. 5A. Each end plug has attached thereto cylindrical spacer members 32 and 33 which serve to stop the travel of piston 30 before it reaches the end plug. In other words, these spacer members define the actual travel of the piston in cylinder 26.

In accordance with this invention and the method thereof, means are provided to orient the stator sections properly in the stator housing. As shown in FIG. 5B, the end of piston rod 29 is attached to cylindrical orienting plug 34. The plug is attached to the end of the piston rod by bolt 35. Orienting plug 34 includes stud 36 which is threaded at one end as shown for connecting the stud to orienting plug body **34*a*. The other end of stud 36 provided with radial grooves to anchor body 37 of elastomeric material to the front end of the orienting plug body. Body 37 of rubber or other elastermeric material is shaped to fit the obround end of the opening that extends through the stator sections as shown in FIG. 7. With the body of elastomeric material 37 extending into the ends of openings in the stator sections, relative rotation will be prevented between the stator sections and orienting plug 34**.

To prevent the orienting plug and piston rod 29 from rotating as they move the stator sections into position in the housing, piston 30 is provided with guide block 39. The block is attached to piston 30 by set screws 40 as shown in FIG. 6. The guide block has an opening through it that is square in cross-section through which extends square rod 42. The end of this rod, as shown in FIG. 5A, is attached to end plug 31 by a threaded connection that prevents the rod from rotating relative to the plug. This will prevent guide plug 39 and piston 30 from rotating relative to the square rod, which in turn will hold piston rod 29 and orienting plug 34 from rotating as the piston moves to the left as shown in FIG. 5A to force the stator section into the stator housing.

In operation then, the apparatus shown in FIGS. 5A, 5B, and 5C move stator section 15 into housing 12 as follows. The section is positioned in breech member 25 as shown and oriented to receive the obround end of orienting plug 34. Fluid pressure is applied against piston 30, causing it to move to the left and force stator section 15 into stator housing 12. The travel of piston 30 and piston rod 29, however, is not sufficient to force the first stator section all the way to its desired position at the lower end of housing 12. Therefore, it is first moved as far into the housing as the piston can move it. The piston is then retracted and an extension is placed between the stator section and orienting plug 34 and the process repeated moving the stator section into the housing the distance of the available stroke of the piston. The piston is then retracted again and second extension is positioned through the breech member and the piston assembly is ready to move the stator section to its desired position in the housing.

This is the situation shown in FIGS. 8A and 8B. Piston 30 is retracted as shown in FIG. 8A. After the first step in moving section 15 into position, at the end of the stroke, orienting plug 34 was released from piston rod 29 and the piston rod retracted. Extension member 45 was placed in the breech member in alignment with the piston rod and the stator housing. The left hand end of the extension member is provided with portion **45*a* of reduced diameter to extend into the opening in the orienting plug in which piston rod 29 was previously located. Bolt 45*b* attaches the extension to the orienting plug in the same manner in which the orienting plug was connected to the end of the rod previously. Thus, relative rotation between the orienting plug and the extension member is prevented. The other end, the right hand end, as viewed in FIG. 8B, was connected to the piston rod by a bolt that extended through the end of the piston rod and end plug 46 mounted in the end of the extension. Relative rotation then was prevented between the two and the stator section was moved the second step into the housing. Bolt 47 was then removed and second extension 48 was positioned for attachment to the end of extension 45, again by bolt 47, as shown in FIG. 8B The other end of extension 48, the second extension, was attached to the end of piston rod 29 by bolt 49 as shown in FIG. 8A. By moving the piston 30 to the left with the addition of the two extensions 45 and 48, section 15 can now be moved into the desired position at the lower end of the stator housing. Extension 48 is then removed through the breach opening, the rod moves forward and is connected to the end of extension 45 which it then retracts; extension 45** is removed and the apparatus is ready to begin the movement of the second stage into the stator housing.

This can be accomplished in two strokes of the piston using only one extension and of course the 1st stage, stage 13, can be positioned without the need of an extension. At all times, the piston and the piston rod cannot move from the selected orientation when the first stator section was moved into the stator housing. With each stator section being equal to one turn of the helix, when the sections are completely positioned in end-to-end abutting relationship in the stator housing, their openings will be oriented so that there will be a continuous helical opening extending through all three stator sections.

To remove a section, for example if it was desired to remove the upper section because it had worn to the extent that it had to be replaced, the stator housing could be turned around and connected with its lower end connected to the breech member. Then the orienting plug could be positioned to engage the lower end of section 15 and the piston used to force upper section 13 out of the stator housing by exerting force on the lower section 15. With this section removed, the housing could be turned around and attached with its upper end to the breech member and a new upper section 13 placed into the housing.

From the foregoing, it will be seen that this invention is one well adapted to attain all of the ends and objects hereinabove set forth, together with other advantages which are obvious and which are inherent to the apparatus and method.

It will be understood that certain features and sub-combinations are of utility and may be employed without reference to other features and sub-combinations. This is contemplated by and is within the scope of the claims.

As many possible embodiments may be made of this invention without departing from the scope thereof, it is to be understood tht all matter herein set forth or shown in the accompanying drawings is to be interpreted as illustrative and not in a limiting sense.

The invention having been described, what is claimed is:

1. A method of assembling a plurality of stator sections having helical openings therethrough in a housing to form a multi-stage stator for a fluid powered down hole motor having a continuous helical opening through the sections comprising the steps of positioning a breech member in axial alignment with the housing, placing a stator section in the breech member, rotating the section to place the helical opening in the section in the desired orientation, forcing the first stator section from the breech member into the housing to the desired position while holding the section from rotating from the desired orientation, and repeating the above steps until the desired number of stator sections are positioned in the housing with their openings forming a continuous helical opening.

2. A removable section for the stator of a positive displacement multistage motor of the Moineau type comprising a cylindrical body of elastomeric material having a helical opening extending longitudinally therethrough with a pitch equal to double the pitch of the rotor, a cylindrical reinforcing member of rigid material embedded in the body of elastomeric material, and an annular portion of the elastomeric material having an outside diameter greater than the housing in which it is to be placed to cause the annular portion to be compressed between the housing and the reinforcing member to form a fluid seal between the section and the housing and to provide sufficient friction therebetween to hold the section from rotating relative to the housing when fluid is forced through the opening.

3. The removable section of claim 2 in which the pitch of the helical opening is equal to the length of the section.

4. In a downhole fluid powered motor having a stator with a helically-shaped opening extending longitudinally therethrough and a helically-shaped rotor located in the stator opening, wherein the improvement comprises a stator having a housing and a plurality of removal stator sections located in end-to-end, abutting relationship in the stator housing, each stator section including a cylindrical body of elastomeric material having a longitudinally extending opening therethrough, said opening being shaped to combine with the other sections to form a continuous helical opening through the stator sections to receive the helically shaped rotor, means for holding the stator sections from longitudinal movement relative to the stator housing, and seal means and for preventing fluid from flowing between the stator sections and the housing, said seal means comprising annular portions of the body of elastomeric material that have an outside diameter greater than the inside diameter of the housing.

5. The motor of claim 4 in which each stator section includes a cylindrically-shaped rigid reinforcing member embedded in the body of elastomeric material to compress the annular portions of the elastomeric material between the inside of the housing and the reinforcing member when the stator section is positioned in the housing.

6. A downhole fluid operated motor comprising a stator and a helically-shaped rotor, said stator including a housing and a plurality of removal stator sections arranged in end-to-end, abutting relationship in the housing, said stator sections being provided with a longitudinally extending helical opening to receive the helical rotor, said sections being positioned for the openings to form a continuous helical opening through the stator, each section further comprising a cylindrical body of elastomeric material having at least a portion thereof with an outside diameter larger than the inside diameter of the housing to cause said portion of the elastomeric material to form a fluid seal between the stator section and the inside surface of the housing when the section is positioned in the housing and to provide sufficient friction between the section and the housing to hold the section from rotating relative to the housing due to the torque imposed on the section by the fluid passing through the opening in the section to cause the rotor to rotate relative to the stator section.

7. The motor of claim 6 in which each stator section includes a cylindrically-shaped rigid reinforcing member embedded in the body of elastomeric material to compress the annular portions of the elastomeric material between the inside of the housing and the reinforcing member when the stator section is positioned in the housing.

* * * * *